US005963118A

United States Patent [19]

Kawano et al.

[11] Patent Number: 5,963,118

[45] Date of Patent: Oct. 5, 1999

[54] ELECTROMAGNETIC COIL AND MANUFACTURING APPARATUS FOR THE SAME

[75] Inventors: Keisuke Kawano, Kariya; Kazutoyo Oosuka, Gamagoori; Noriyasu Inomata, Toyota, all of Japan

[73] Assignee: Nippondenso Co., Ltd., Kariya, Japan

[21] Appl. No.: 08/942,793

[22] Filed: Oct. 2, 1997

Related U.S. Application Data

[62] Division of application No. 08/666,817, Jun. 19, 1996, Pat. No. 5,736,917.

[30] Foreign Application Priority Data

Jun. 19, 1995 [JP] Japan ..... 7-151950

[51] Int. Cl.[6] ..... H01F 27/29; H01F 27/30

[52] U.S. Cl. ..... 336/198; 336/208; 336/192

[58] Field of Search ..... 336/192, 198, 336/208, 190, 191

[56] References Cited

U.S. PATENT DOCUMENTS

| | | | |
|---|---|---|---|
| 3,215,965 | 11/1965 | Subik | 336/208 |
| 3,368,177 | 2/1968 | Hilgers | 336/198 |
| 3,851,830 | 12/1974 | Barthalon | 336/189 |
| 5,209,414 | 5/1993 | Clemens et al. | 242/25 R |

FOREIGN PATENT DOCUMENTS

| | | | |
|---|---|---|---|
| 0 518 737 A1 | 12/1992 | European Pat. Off. . | |
| 34 33 003 | 3/1986 | Germany . | |
| 41 36 005 | 10/1992 | Germany . | |
| 2-106910 | 4/1990 | Japan | 336/190 |
| 2-18572 | 4/1990 | Japan | 336/189 |
| 2-156513 | 6/1990 | Japan | 336/189 |
| 5-29171 | 2/1993 | Japan . | |
| 5-115159 | 5/1993 | Japan . | |
| 6-27922 | 7/1994 | Japan . | |
| 60-107813 | 6/1995 | Japan . | |

*Primary Examiner*—Michael L. Gellner
*Assistant Examiner*—Anh Mai
*Attorney, Agent, or Firm*—Pillsbury Madison & Sutro LLP

[57] ABSTRACT

A traverse shaft section 609 shifts in response to the rotation of a bobbin rotating section 604 with a predetermined winding pitch P1 equivalent to two to 10 times the diameter of a wire rod 520. With this shift movement of traverse shift section 609, wire rod 520 extracted from a winding nozzle section 610 shifting together with traverse shaft section 609 is wound spirally along a slant surface 530 formed by a first winding section 541 at the winding pitch P1 equivalent to two to 10 times the diameter of a wire rod 520. As a result, an advancing-side wire rod 520*a* and a reversing-side wire rod 520*b* cross over each other at opposing inclinations. Hence, it becomes possible to prevent the reversing-side wire rod 520*b*, when wound on the advancing-side wire rod 520*a*, from pulling and dislocating the advancing-side wire rod 520*a* from its regular winding position, thereby eliminating undesirable winding collapse.

5 Claims, 6 Drawing Sheets

ELECTROMAGNETIC COIL AND MANUFACTURING APPARATUS FOR THE SAME

This is a division of Application Ser. No. 08/666,817, filed Jun. 19, 1996, U.S. Pat. No. 5,736,917 Apr. 7, 1998.

BACKGROUND OF THE INVENTION

1. Field of the Invention

This invention generally relates to an electromagnetic coil and the manufacturing apparatus for the same, and more particularly to an electromagnetic coil preferably applied, for example, to an ignition coil for an internal combustion engine or to a compact transformer, and the manufacturing apparatus for such an electromagnetic coil.

2. Related Art

Conventionally, to improve the withstanding voltage and efficiency, a so-called oblique lap winding method shown in FIG. 11 has been preferably used for winding electromagnetic coils applied to ignition coils of internal combustion engines or to compact transformers. "Oblique lap winding", generally designated so in this specification, is one of a plurality of winding methods for winding an electromagnetic coil. As shown in FIG. 11, a wire rod 702 constituting the electromagnetic coil is wound around a cylindrical body of a bobbin 701. More specifically, wire rod 702 is wound and accumulated obliquely at a predetermined gradient angle θ0 with respect to the outer cylindrical surface of bobbin 701.

However, when an electromagnetic coil 700 is fabricated by the above-described oblique lap winding method, there is a possibility for wire rod 702 to have a diameter not larger than 0.1 mm, such that the winding collapse may occur when wire rod 702 is wound around bobbin 701. Such a winding collapse tends to occur when a winding pitch P0 of wire rod 702 is set smaller than two times the diameter of wire rod 702, because wire rod 702, when wound on an already wound wire rod 702, possibly pulls away this already wound wire rod 702 from its regular winding position. According to FIG. 11, a reversing-side wire rod 702*b* is accumulated on an advancing-side wire rod 702*a*. More specifically, when reversing-side wire rod 702*b* is wound around bobbin 701, a force acting in the radially inward direction of bobbin 701 forces the reversing-side wire rod 702*b* to dislocate the already wound advancing-side wire rod 702*a* in the axial direction of bobbin 701. Hence, the advancing-side wire rod 702*a* causes undesirable excursion from the predetermined winding position, resulting in the winding collapse.

If such a winding collapse occurs when the wire rod is wound around the bobbin, there will be a possibility that the wire rod dislocated from its regular winding position may approach a wire rod located at a higher-potential winding position. In such a case, corona discharge or electric breakdown may be induced.

To prevent this kind of winding collapse, there are proposed various winding methods for electric winding components as disclosed, for example, in Unexamined Japanese Patent Application No. HEI 2-106910, published in 1990, or in Unexamined Japanese Patent Application No. HEI 2-156513, published in 1990. According to these conventional winding methods, the gradient angle θ0 of the wire rod shown in FIG. 11 is, for example, set to an angle of 45° or less, and a winding pitch P0 is set smaller than two times the outer diameter of the wire rod, thereby preventing the winding collapse previously described.

The smaller the gradient angle θ0 of wire rod 702 wound around bobbin 701 shown in FIG. 11, the larger the winding number of wire rod 702 per single slant surface. An electric potential becomes large between two neighboring wire rods 702 of two adjacent slant surfaces. This means that the withstanding voltage of wire rod 702 may not be assured or maintained. Hence, it is generally necessary to increase the gradient angle θ0 of wire rod 702.

However, according to the winding methods of electric winding components disclosed in the Unexamined Japanese Patent Application No. HEI 2-106910 and the Unexamined Japanese Patent Application No. HEI 2-156513, it was not possible for the wire rod having an outer diameter not larger than 0.1 mm to prevent the above-described winding collapse unless the gradient angle θ0 shown in FIG. 11 is set to a small angle.

Furthermore, according to the ignition coil disclosed in Unexamined Japanese Patent Application No. 60-107813, published in 1985, there is proposed a winding method of winding a wire rod by pressing the wire rod from radial directions by a pair of guides made of felt. However, even if this winding method is used, the winding collapse will be caused when the gradient angle θ0 shown in FIG. 11 is set to a large angle.

Accordingly, the winding methods for electric winding components disclosed in the Unexamined Japanese Patent Application No. HEI 2-106910 and the Unexamined Japanese Patent Application No. HEI 2-156513 and the ignition coil disclosed in the Unexamined Japanese Patent Application No. 60-107813 have a problem that a sufficient withstand voltage cannot be maintained when the gradient angle θ0 is set to a large angle for the wire rod having an outer diameter not larger than 0.1 mm.

Furthermore, when the winding nozzle feeds the wire rod wound around the bobbin, a distance between the winding nozzle and the winding position of the wire rod on the bobbin is believed to be another factor causing winding collapse when the wire rod is wound around the bobbin. As shown in FIG. 11, the distance between winding nozzle 703 and the winding position of the wire rod 702 becomes a minimum distance L01 at the position where wire rod 702 transfers from the layer of reversing-side wire rod 702*b* to the layer of advancing-side wire rod 702*a*, and becomes a maximum distance L02 at the position where wire rod 702 transfers from the layer of advancing-side wire rod 702*a* to the layer of reversing-side wire rod 702*b*. Therefore, the distance to winding nozzle 703 is small when the winding position of wire rod 702 is located at a radially outside position of bobbin 701. On the other hand, the distance to winding nozzle 703 is large when the winding position of wire rod 702 is located at a radially inside position of bobbin 701. The swingable width of wire rod 702 extracted from winding nozzle 703 varies in proportion to this distance. Accordingly, the swingable width of wire rod 702 is increased with increasing distance between winding nozzle 703 and the winding position of wire rod 702. That is, the swingable width of wire rod 702 increases as the winding position of wire rod 702 approaches toward the outer cylindrical wall of bobbin 701. In other words, the alignment of wire rod 702, when wound around the bobbin 701, tends to be deteriorated in the vicinity of the outer cylindrical wall of bobbin 701. Accordingly, there is a tendency that the winding collapse is possibly induced as wire rod 702 approaches the outer cylindrical wall of bobbin 701.

SUMMARY OF THE INVENTION

Accordingly, in view of above-described problems encountered in the prior art, a principal object of the present invention is to provide an electromagnetic coil capable of improving its insulation quality and a manufacturing apparatus for the same.

In order to accomplish this and other related objects, the present invention provides a novel and excellent electromagnetic coil comprising a wire rod wound around a coil shaft, characterized in that the wire rod is wound around the coil shaft obliquely so as to form a slant layer of the wire rod, and a pitch of the wire rod constituting the slant layer is at least partly equivalent to two to 10 times a diameter of the wire rod, thereby winding the wire rod around the coil shaft with a gap.

According to features of preferred embodiments of the present invention, the pitch of the wire rod is set somewhere in a range two to four times of the diameter of the wire rod. The slant layer of the wire rod has a gradient angle not smaller than 6° with respect to the axis of the coil shaft. The gradient angle of the slant layer of the wire rod is set somewhere in a range of 6° to 20°. The gradient angle is preferably in a range of 8° to 17°, more preferably 13° or equivalents. The wire rod forms a plurality of winding layers accumulated sequentially, each of the winding layers is inclined at a predetermined angle with respect to the axis of the coil shaft. These plural winding layers comprise a wide-gap winding layer having a pitch of the wire rod equivalent to two to 10 times the diameter of the wire rod so as to have a gap, so that the wire rod forming an upper winding layer disposed on the wide-gap winding layer is brought into contact with the wire rod forming a lower winding layer disposed below the wide-gap winding layer through the gap of the wide-gap winding layer. The pitch of the wire rod constituting the wide-gap winding layer is set somewhere in a range of two to four times the diameter of the wire rod. The upper winding layer and the lower winding layer comprise a portion having a pitch of the wire rod equivalent to two to 10 times the diameter of the wire rod. Alternatively, the lower winding layer has a pitch of the wire rod not larger than two times the diameter of the wire rod.

Furthermore, a second aspect of the present invention provides a novel and excellent electromagnetic coil comprising a cylindrical bobbin defining a winding section, a winding transfer portion partly formed on an outer cylindrical wall of the winding section so as to extend in a circumferential direction thereof, a winding stopper portion formed on the remainder of the cylindrical wall of the winding section so as to extend in the circumferential direction, and a wire rod wound in the winding section so as to form a multiple winding layer sequentially extending from one end toward the other end.

According to the features of the preferred embodiments, the winding transfer portion and the winding stopper portion are aligned in the same circumferential direction, while adjacent winding transfer portion and adjacent winding stopper portion are spaced from these winding transfer portion and the winding stopper portion in the axial direction.

Still further, a third aspect of the present invention provides a novel and excellent electromagnetic coil comprising a cylindrical bobbin defining a winding section and having a circular cross section, an edge portion formed on an outer cylindrical wall of the winding section so as to extend in an axial direction of thereof, and a wire rod wound in the winding section so as to form a multiple winding layer sequentially extending from one end toward the other end.

According to the features of the preferred embodiments, the edge portion is formed by a curve surface defining the outer cylindrical wall of the winding portion and a flat surface formed by partly cutting away the outer cylindrical wall of the winding portion.

Moreover, a fourth aspect of the present invention provides a novel and excellent manufacturing apparatus of an electromagnetic coil comprising a support section for rotatably supporting a bobbin, a rotational drive section for rotating the support section, a nozzle section for feeding a wire rod to the bobbin, and a shift mechanism for shifting the nozzle section along an oblique line inclined at a predetermined angle with respect to an axis of the bobbin.

According to the features of the preferred embodiments, the manufacturing apparatus of the present invention further comprises a control section for actuating the shift mechanism in synchronism with rotation of the rotational drive section. The manufacturing apparatus of the present invention further comprises an auxiliary shift mechanism for shifting the nozzle section in parallel with the axis of the bobbin. The control section actuates both of the shift mechanism and the auxiliary shift mechanism in synchronism with rotation of the rotational drive section. And, the control section shifts the auxiliary shift mechanism by a predetermined stroke in response to a predetermined stroke of the shift mechanism.

BRIEF DESCRIPTION OF THE DRAWINGS

The above and other objects, features and advantages of the present invention will become more apparent from the following detailed description which is to be read in conjunction with the accompanying drawings, in which.

DETAILED DESCRIPTION OF THE PREFERRED EMBODIMENTS

Figure 1:
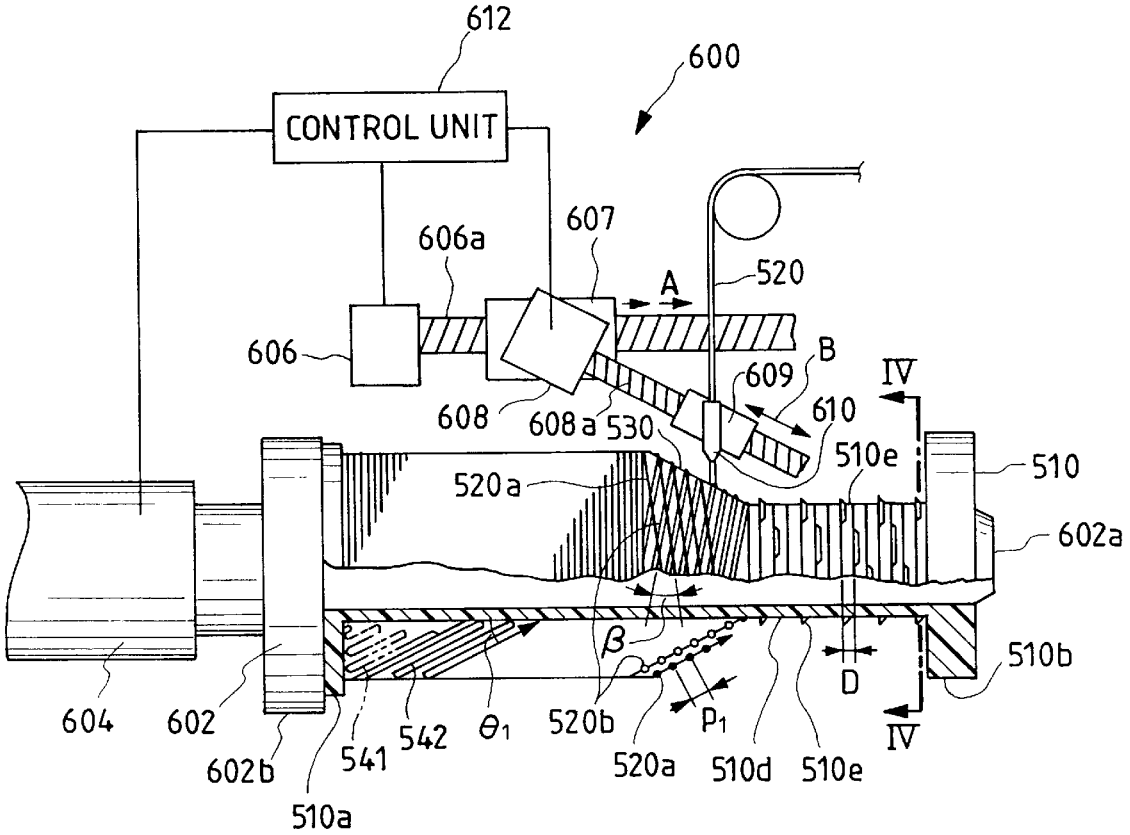
FIG. 1 is a schematic view showing an oblique lap winding coil manufacturing apparatus and an oblique lap winding coil being wound in accordance with a first embodiment of the present invention.

Preferred embodiments of the present invention will be explained in greater detail hereinafter, with reference to the accompanying drawings. Identical parts are denoted by the same reference numerals throughout views.

First Embodiment

An electromagnetic coil of the present invention applicable to an ignition coil for an internal combustion engine will be explained with reference to FIGS. 2 through 5.

Figure 2:
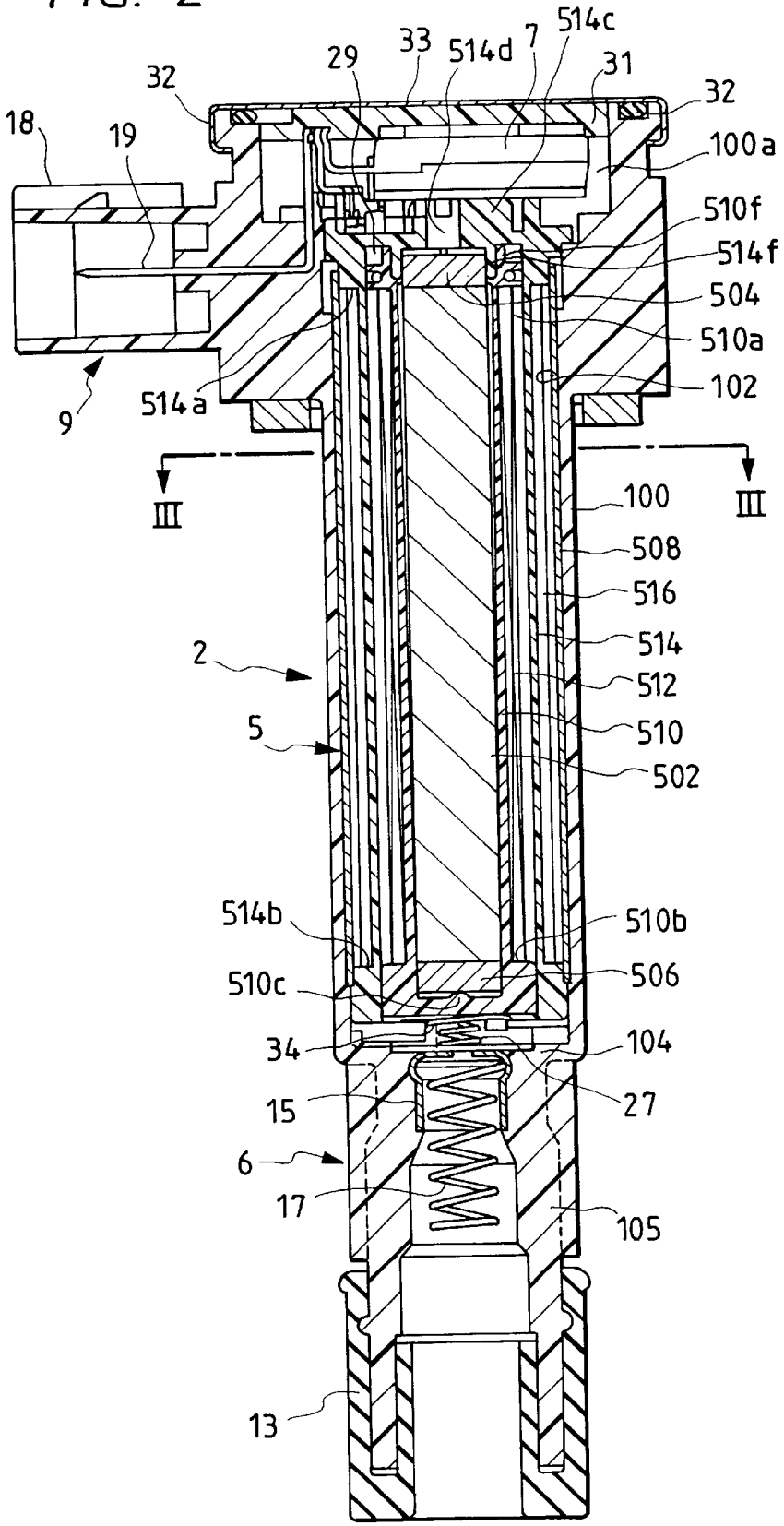
FIG. 2 is a vertical cross-section al view showing an ignition coil for an internal combustion engine incorporating the oblique lap winding coil in accordance with the first embodiment of the present invention.

As shown in FIG. 2, an ignition coil for an internal combustion engine (hereinafter referred to as "ignition coil") 2 chiefly comprises a cylindrical transformer section 5, a control circuit section 7 positioned at one end of transformer section 5 for controlling the flow of a primary current supplied to transformer section 5, and a connecting section 6 positioned at the other end of transformer section 5 for supplying a secondary voltage of transformer section 5 to an ignition plug (not shown).

Ignition coil 2 comprises a cylindrical casing 100 which is a resin product and serves as a housing of ignition coil 2. An accommodation chamber 102 is formed in this casing 100. This accommodation chamber 102 is filled with insulation oil 29 and accommodates therein the transformer section 5 generating a high-voltage output and the control circuit section 7. A control signal input connector 9 is provided at the upper end of accommodation chamber 102. A bottom section 104 is formed at the lower end of accommodation chamber 102. Bottom section 104 is closed by the bottom section of a later-described cup 15. The outer cylindrical wall of this cup 15 is covered by the connecting section 6 positioned at the lower end of casing 100.

Connecting section 6 comprises a cylindrical portion 105 integral with and extending from casing 100 for accommodating an ignition plug (not shown) therein. A plug cap 13, made of rubber, is coupled around the opening end of this cylindrical portion 105. More specifically, in the bottom section 104 positioned at the upper end of cylindrical portion 105, there is provided the metallic cup 15 serving as a conductive member. Metallic cup 15 is integrally formed with the resin material of casing 100 by insert molding. Accordingly, accommodation chamber 102 and connecting section 6 are partitioned hermetically.

A spring 17 is a compression spring supported at its base end on the bottom of cap 15. When the ignition plug (not shown) is inserted into the inside bore of connecting section 6, an electrode of the ignition plug is brought into electrical contact with the distal end of spring 17.

Control signal input connector 9 consists of a connector housing 18 and connector pins 19. Connector housing 18 is integrally formed with casing 100. A total of three connector pins 19 are inserted in and integrally molded together with connector housing 18 so as to extend across casing 100 and connectable with an external component.

An opening 100*a* is formed at the upper end of casing 100. Transformer section 5, control circuit section 7, and insulating oil 29 are inserted into accommodation chamber 102 from outside through this opening 100*a*. This opening 100*a* is hermetically closed by a resin lid 31 and an O-ring 32. Furthermore, the upper end of casing 100 is caulked by a metallic cover 32 covering the surface of resin lid 31.

Transformer section 5 comprises an iron core 502, magnets 504 and 506, a secondary spool 510, a secondary coil 512, a primary spool 514 and a primary coil 516.

Iron core 502 of a cylindrical shape is constituted by laminating thin silicon steel plates so as to form a circular cross section. Magnets 504 and 506 are fixed by adhesive tape at axial ends of this iron core 502. These magnets 504 and 506 have the same polarity whose direction is opposed to the direction of the magnetic flux to be generated when the coil is excited.

Secondary spool 510, serving as a bobbin, is a resin product formed into a cylindrical body having a circular cross section and having a bottom with flanges 510*a* and 510*b* provided at both ends thereof. The lower end of secondary spool 510 is substantially closed by a bottom portion 510*c*.

A terminal plate 34 is fixed on the bottom portion 510*c* of secondary spool 510. This terminal plate 34 is electrically connected to a lead (not shown) extracted from one end of secondary coil 512. A spring 27 is fixed to this terminal plate 34, so that terminal plate 34 can be brought into contact with cup 15. The terminal plate 34 and spring 27 cooperatively serve as spool side conductive member. A high-voltage output, when induced in secondary coil 516, is supplied to the electrode of the ignition plug (not shown) via these terminal plate 34, spring 27, cup 15 and spring 17.

A cylindrical portion 510*f* is formed on the end of spool 510 opposed to bottom portion 510*c*, so as to protrude therefrom coaxially with secondary spool 510. Iron core 502 and magnet 506 are accommodated in the bore of this secondary spool 510. Secondary coil 512 is positioned around the outer cylindrical surface of secondary spool 510. Secondary coil 512 is wound by a later-described winding apparatus.

Figure 4:
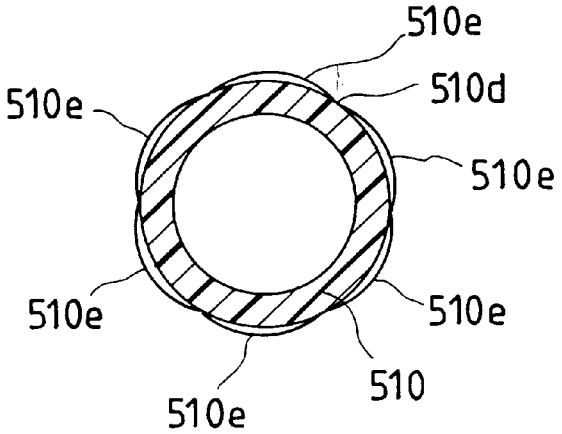
FIG. 4 is a cross-sectional view taken along a line IV—IV of a primary spool shown in FIG. 1.

A cylindrical winding portion 510d, positioned between two flanges 510*a* and 510*b* of secondary spool 510, is provided with a plurality of protrusions 510*e* on a cylindrical surface thereof, as shown in FIG. 4. These protrusions 510*e* serve as winding stoppers. FIG. 4 shows a condition where wire rod 520 is not yet wound around secondary spool 510. FIG. 4 clearly shows the position of each protrusion 510*e* with respect to a cross section of winding portion 510*d* which is taken along a radius thereof and seen from the axial direction.

Each protrusion 510*e* extends in the circumferential direction of winding portion 510*d* within a predetermined angular region. An appropriate gap portion, serving as a winding transfer portion, is formed between two protrusions 510*e* and 510*e* disposed adjacent each other in the circumferential direction. Wire rod 520 is wound around winding portion 510*d* by passing through this gap portion without causing interference between them. More specifically, the outer cylindrical wall of secondary spool 510 is basically the gap portion unless protrusion 510*e* is formed thereon. FIG. 1, which is a schematic view showing a later-described winding apparatus, clearly shows the position of each protrusion 510*e* with respect to the cylindrical surface of secondary spool 510.

As shown in FIG. 1, protrusions 510*e*—510*e*, formed on the cylindrical surface of winding portion 510*d*, are spaced at equal intervals in the circumferential directions. More specifically, two protrusions 510*e* and 510*e* adjacent each other in the circumferential direction are disposed on a spiral line extending along the cylindrical surface of winding portion 510*d*. The purpose of aligning each protrusion 510*e* in this manner is to prevent any interference between wire rod 520 and each protrusion 510*e* when wire rod 520 is wound around winding portion 510*d*. Thus, wire rod 520 is prevented from crossing over protrusions 510*e* when wire rod 520 is wound around secondary spool 510. For example, an insulating sheath covering the outer surface of wire rod 520 will be prevented from being damaged by protrusion 510*e* formed into a sharp configuration.

The winding stopper of the present invention is not limited only to protrusion 510*e;* for example, a comparable winding stopper applicable to this invention could be a groove extending in the circumferential direction of winding portion 510*d* of secondary spool 510 within a predetermined angular region. In this case, an appropriate gap portion, serving as a winding transfer portion, is formed between two grooves disposed adjacent each other in the circumferential direction. Wire rod 520 is wound around winding portion 510*d* by passing through this gap portion without causing interference between them. More specifically, the outer cylindrical wall of secondary spool 510 is basically the gap portion unless the groove serving as winding stopper is formed thereon. Alternatively, it is also preferable to provide an annular groove extending entirely around winding portion 510*d.* In this case, the annular groove has an undulated bottom to differentiate the depth of the groove locally, so that a deep portion of the annular groove serves as the winding stopper of the present invention while a shallow portion serves as the winding transfer portion of the present invention.

Figure 5:
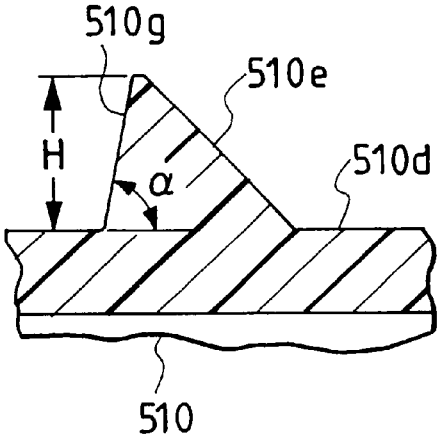
FIG. 5 is an axial cross-sectional view schematically showing a protrusion formed on a secondary spool.

FIG. 5 shows a cross section of secondary spool 510, taken along the axis of secondary spool 510. As apparent from FIG. 5, protrusion 510*e* formed on the outer cylindrical surface of secondary spool 510 has a triangular cross section. A slant surface 510*g* of protrusion 510*e,* facing the advancing direction of wire rod 520 wound around the winding portion 510*d,* is inclined at an angle α. Slant surface 510*g* prevents wire rod 520 from riding over protrusion 510*e* when it is wound around winding portion 510*d.* A practical value for the angle α is, for example, 60° or above. The height H of protrusion 510*e* extending in a radially outer direction of secondary spool 510 is larger than the diameter of wire rod 520 wound around secondary spool 510.

However, the cross section of protrusion 510*e* is not limited to a triangle, and therefore can be any of a rectangle, a polygon, a semi-circle or the like, if such a configuration is producible through the resin molding processing of secondary spool 510.

Hereinafter, it is assumed that wire rod 520, wound around secondary spool 510, has a diameter of 0.07 mm including a thickness of its insulating sheath. Wire rod 520 is obliquely wound at an inclined angle 15°. The size of each protrusion 510*e* formed on secondary spool 510 will be explained with reference to FIGS. 1 and 5.

As shown in FIG. 1, protrusions 510*e* are formed on the outer cylindrical wall of winding portion 510*d* at axial intervals of "D". The interval "D" is appropriately determined in accordance with the diameter of wire rod 520 and others. For example, the axial interval "D" is set to 0.02 mm when the diameter of wire rod 520 is 0.07 mm. Meanwhile, the maximum height "H" of each protrusion 510*e* is set to three times the diameter of wire rod 520. Hence, the maximum height "H" is set to 0.02 mm when the diameter of wire rod 520 is 0.07 mm. Furthermore, as each protrusion 510*e* extends in the circumferential direction of secondary spool 510 within a limited angular range, wire rod 520 is not bent by protrusion 510*e* at a smaller angle. Hence, wire rod 520 can easily shift an adjacent winding layer. Of slant surfaces defining protrusion 510*e,* slant surface 510*g* opposing the winding advance direction of wire rod 520 is set to the previously described angle α, not smaller than 60° and preferably 85°, with respect to the surface of winding portion 510*d.*

With the formation of protrusion 510*e* on winding portion 510*d* in the above-described manner, slant surface 510*g* surely stops the shift movement of wire rod 520 wound around the outer cylindrical wall of winding portion 510*d* even if wire rod 520 slips in the axial direction. Thus, it becomes possible to surely prevent the wiring from collapsing due to slippage of wire rod 520 along the outer cylindrical wall of winding portion 510*d.*

As shown in FIG. 2, primary spool 514, which is a resin molding product, is formed into a cylindrical body with a bottom and opposing upper and lower flanges 514*a* and 514*b.* A lid portion 514*c* closes the upper end of primary spool 514. This primary spool 514 has an outer cylindrical surface on which primary coil 516 is wound.

Lid portion 514*c* of primary spool 514 is formed with a cylindrical portion 514*f* extending toward the lower end of primary spool 514. Cylindrical portion 514*f* is coaxial with primary spool 514. An opening portion 514*d* is formed on lid portion 514*c*. This cylindrical portion 514*f* is disposed or inserted coaxially inside the cylindrical portion 510*f* of secondary spool 510 when the previously described secondary spool 510 is assembled with primary spool 514. Accordingly, when primary spool 514 and secondary spool 510 are assembled, iron core 502 with magnets 504 and 506 at both ends thereof is interposed or sandwiched between lid portion 514*c* of primary spool 514 and bottom portion 510*c* of secondary spool 510.

Figure 3:
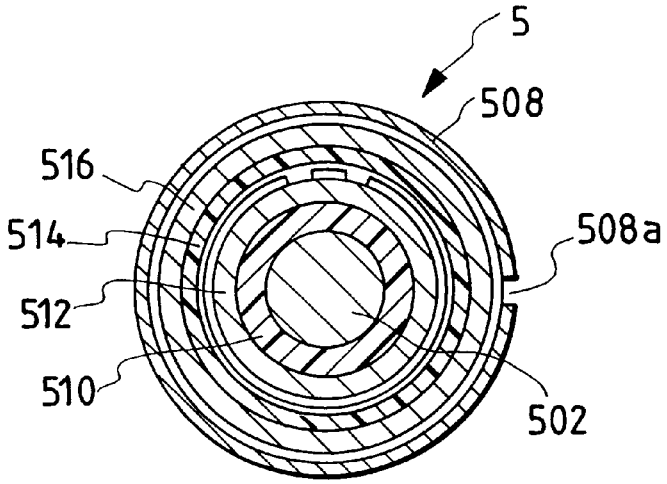
FIG. 3 is a cross-sectional view taken along a line III—III of a transformer section shown in FIG. 2.

As shown in FIGS. 2 and 3, primary coil 516 is wound around primary spool 514. Provided outside primary coil 516 is an auxiliary core 508 having a slit 508*a*. This auxiliary core 508 is formed by winding a thin silicon steel in a cylindrical shape with axially extending slit 508*a* kept between its winding initial edge and its winding terminal edge. The axial length of auxiliary core 508 is equal with the distance from the outer periphery of magnet 504 to the outer periphery of magnet 506. With this arrangement, it becomes possible to reduce eddy current flowing in the circumferential direction of auxiliary core 508.

Accommodation chamber 102, accommodating transformer section 5 and the others therein, is filled with insulating oil 29 with a slight air space remaining at the upper part thereof. Insulating oil 29 enters through the lower end opening of primary spool 514, opening portion 514*d* opened at the center of lid portion 514*c* of primary spool 514, the upper end opening of primary spool 510 and other openings not shown. Insulating oil 29 ensures electrical insulation among iron core 502, secondary coil 512, primary core 516, auxiliary core 508 and others.

Next, a winding apparatus for winding wire rod 520 around secondary spool 510 to form the secondary coil 512 will be explained with reference to FIG. 1.

As shown in FIG. 1, a winding apparatus 600 for winding secondary coil 512 comprises a bobbin support section 602, a bobbin rotating section 604, a feed shaft section 607, a traverse shaft section 609, a winding nozzle section 610, a control section 612 and others.

Bobbin support section 602, acting as a support section, comprises a shaft portion 602*a* having an axial length longer than that of secondary spool 510, and a stopper portion 602*b* receiving flange 510*a* of secondary spool 510 when shaft portion 602*a* is inserted in an axial bore of secondary spool 510. Bobbin support section 602 is rotated in a predetermined direction by bobbin rotating section 604 comprising a rotation mechanism.

Bobbin rotating section 604, acting as a rotational drive section, is controlled by control section 612. Namely, control section 612 controls the start and stop of rotation of bobbin rotating section 604 as well as the speed of its rotation. The control of bobbin rotating section 604 is correlated with other controls of feed shaft section 607 and traverse shaft section 609 which are also controlled by control section 612.

Feed shaft section 607 comprises a mechanism shiftable along a rotational shaft 606*a* in response to the rotation of rotational shaft 606*a*. The rotational shaft 606*a* extends in parallel with the axis of secondary spool 510 set on bobbin support section 602 with a predetermined clearance. When traverse shaft section 609 causes a single complete reciprocative movement, feed shaft section 607 advances in the direction of an arrow "A" by a predetermined distance.

A rotational shaft drive section 606 is positioned at a base end of rotational shaft 606*a,* and includes a mechanism for rotating this rotational shaft 606*a*. Control section 612 controls this rotational shaft drive section 606.

Traverse shaft section 609 comprises a mechanism shiftable along a rotational shaft 608*a* in synchronism with the rotation of rotational shaft 608*a*. Rotational shaft 608*a* is inclined with respect to the shaft of secondary spool 510 at a predetermined angle. Traverse shaft section 609 causes a reciprocative movement along rotational shaft 608*a* in accordance with the rotational direction of rotational shaft 608*a,* thereby shifting winding nozzle section 610 attached on traverse shaft section 609. With this arrangement, winding nozzle section 610 shifts in parallel with an inclined surface 530 formed by wire rod 520 obliquely wound on winding portion 510*d*. The gradient angle of rotational shaft 608*a* with respect to the, axis of secondary spool 510 can be arbitrarily varied during the winding operation of wire rod 520 wound around secondary spool 510.

A rotational shaft drive section 608 is attached on feed shaft section 607 and positioned on a base end of rotational shaft 608*a*. Rotational shaft drive section 608 comprises a mechanism for rotating rotational shaft 608*a*. Control section 612 controls this rotational shaft drive section 608, in the same manner as another rotational shaft drive section 606.

Winding nozzle section 610, acting as a nozzle section, is attached on traverse shaft section 609 and causes a shift movement in accordance with the reciprocative movement. Thus, wire rod 520 extracted from winding nozzle section 610 is accurately positioned at a predesignated winding position.

The above-described rotational shaft drive section 608, rotational shaft 608*a* and traverse shaft section 609 cooperatively constitute a drive mechanism of the present invention.

Next, the winding method of the above-described winding apparatus 600 for winding wire rod 520 around secondary spool 510 will be explained with reference to FIGS. 1 and 6.

Figure 6:
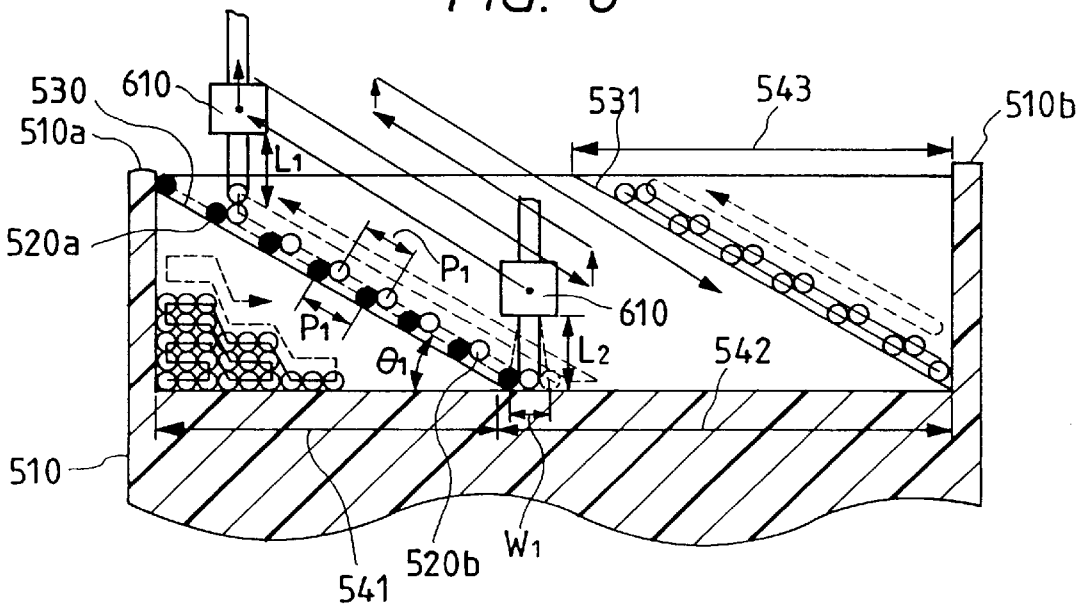
FIG. 6 is a cross-sectional view schematically showing a winding method of the oblique lap winding coil in accordance with the first embodiment of the present invention.

As explained in FIG. 6, wire rod 520 wound around secondary spool 510 is separated into three sections of a first winding section 541, a second winding section 542 and a third winding section 543. The winding method of wire rod 520 is different in each of these three winding sections 541, 542 and 543.

In first winding section 541, wire rod 520 extracted from winding nozzle section 610 is first wound from the inside wall of flange 510*a* toward flange 510*b* by three turns which is a predetermined turn number. Thereafter, wire rod 520 is wound by three turns over the single layer of already wound three-turn wire rod 520 in the reverse direction, i.e. toward flange 510*a,* so as to return to the inside wall of flange 510*a*. Furthermore, wire rod 520 is wound from the inside wall of flange 510*a* toward flange 510*b* by three turns over the two-story layers of already wound three-turn wire rod 520, and further wound another three turns in the same direction next to the bottom layer of already wound three-turn wire rod 520. At this moment, the bottom layer consists of six turns of wire rod 520, the second-story layer consists of three turns of wire rod 520, and the third-story layer consists of three turns of wire rod 520. Then, wire rod 520 is wound over thus formed multi-layer in the reverse direction by six turns toward flange 510*a* and returns the inside wall of flange 510*a*. Subsequently, wire rod 520 is wound from the inside wall of flange 510*a* toward flange 510*b* by three turns over the four-story layers of already wound three-turn wire rod 520, and further wound another three turns in the same direction over the two-story layers of already wound three-turn wire rod 520, and then wound another three turns in the same direction next to the bottom layer of already wound six-turn wire rod 520. At this moment, the bottom layer consists of nine turns of wire rod 520, the second- and third-story layers consist of six turns of wire rod 520, and the fourth- and fifth-story layers consist of three turns of wire rod 520, as shown in FIG. 6.

In this manner, the winding position is advanced in the increment of three turns, which is designated as the predetermined turn number, toward flange 510*b,* thereby forming a multi-layer extending in the radially outward direction in the middle of winding portion 510*d*. Thus, a slant surface 530 is formed at the advancing side of the multi-layer of wire rod 520. The inclination angle θ1 of slant surface 530 is determined by the above-described "predetermined turn number" defining the advancing increment of wire rod 520 toward flange 510*b*. For example, inclination angle θ1 is set to 10° or above. This inclination angle θ1 can be arbitrarily set by varying the "predetermined turn number". As winding nozzle section 610 causes a reciprocative shift movement in accordance with the gradient angle θ1, it is possible to uniformly maintain the alignment of wire rod 520.

The smaller the gradient angle θ1, the winding number of wire rod 520 per single slant surface 530 increases. Thus, an electric potential difference becomes large between two neighboring wire rods 520 of adjacent two slant surfaces. This necessarily requires wire rod 520 to possess a sufficiently high withstanding voltage, resulting in the increase of the thickness of the insulating sheath of wire rod 520 as well as increase of size of transformer section 5. In view of above, it is desirable to set the gradient angle θ1 of the slant layer of wire rod 520 somewhere in the range of 8° to 17°, preferably 13°, 14° or 15°. With this arrangement, it becomes possible to prevent the wiring from collapsing as well as assuring the withstanding voltage required for wire rod 520 of transformer section 5.

In the second winding section 542, wire rod 520 is wound along the slant surface 530 formed in the first winding section 541, so as to form a slant surface having the gradient angle identical with that of slant surface 530. FIG. 1 shows the winding operation of winding apparatus 600 in the second winding section 542, wherein the movement of winding nozzle section 610 is shown schematically. In FIGS. 1 and 6, each black circle or a black wide line represents an advancing-side wire rod 520*a* which is wound around secondary spool 510 in an advancing stroke during which winding nozzle section 610 approaches toward the outer cylindrical wall of secondary spool 510. Meanwhile, each white circle or a white wide line represents a reversing-side wire rod 520*b* which is wound around secondary spool 510 in a reversing stroke during which winding nozzle section 610 departs from the outer cylindrical wall of secondary spool 510.

Traverse shaft section 609 shifts by a predetermined winding pitch P1, e.g. two to 10 times the diameter of wire rod 520, in accordance with rotation of bobbin rotating section 604. Hence, wire rod 520 extracted from winding nozzle section 610 shifting together with this traverse shaft section 609 is wound by this winding pitch P1 on the slant surface 530 formed by first winding section 541. In other words, wire rod 520 is wound spirally along the slant surface 530 at intervals of winding pitch P1 equivalent to two to 10 times the diameter of wire rod 520. Therefore, as shown in FIG. 1, the advancing-side wire rod 520*a* and the reversing-side wire rod 520*b* intersect each other at an angle β. (Hereinafter, this winding method is referred to as "cross winding method")

FIG. 6 shows a condition where advancing-side wire rod 520*a* is wound as a first oblique layer and then reversing-side wire rod 520*b* is wound on this first oblique layer so as to form a second oblique layer. By adopting the cross winding method, advancing-side wire rod 520*a* and reversing-side wire rod 520*b* are wound by the predetermined pitch P1 and it becomes possible to enlarge the intersect angle β at which advancing-side wire rod 520*a* intersects with reversing-side wire rod 520*b*. When the intersect angle β is large, two wire rods 520 overlapped in the up and down direction are brought into contact with each other by crossing points. When the intersect angle β is small, two wire rods 520 overlapped in the up and down direction are brought into contact with each other by line segments. In other words, the larger the intersect angle β, the smaller the contacting portion between two wire rods 520 overlapped in the up and down direction. This is advantageous to prevent reversing-side wire rod 520*b*, when wound on advancing-side wire rod 520*a*, from accidentally pulling away this advancing-side wire rod 520*a* from the predetermined winding position. Thus, undesirable excursion of wire rod 520 is surely eliminated. Hence, it becomes possible to prevent deterioration of insulation quality due to winding collapse.

As described previously, the effect of preventing the winding collapse is ensured with increasing "predetermined winding pitch P1". On the other hand, a larger "predetermined winding pitch P1" will reduce the total winding number per single slant surface 530 formed by the first winding section 541. Hence, to satisfy a predetermined winding number required for secondary coil 512, the number of reciprocative movements of traverse shaft section 609 will be necessarily increased. This will lead to reduction of production efficiency as well as size increase of transformer section 5 due to reduction of winding density. In view of above, it is desirable that the "predetermined winding pitch P1" is set somewhere in the range of two to four times the diameter of wire rod 520. With these settings, it becomes possible to effectively prevent winding collapse without lowering production efficiency as well as increasing the size of transformer section 5.

Furthermore, as shown in FIG. 6, winding nozzle section 610 causes a reciprocative movement in parallel with slant surface 530 formed by first winding section 541. This is effective to maintain the distance between winding nozzle section 610 and the winding position of wire rod 520 at a minimum value no matter where wire rod 520 is positioned with respect to secondary spool 510. More specifically, it is now assumed that "L1" represents a distance between winding nozzle section 610 and the winding position of wire rod 520 at the moment wire rod 520 wound around secondary spool 510 transfers from the layer of reversing-side wire rod 520*b* to the layer of advancing-side wire rod 520*a*. On the other hand, "L2" represents a distance between winding nozzle section 610 and the winding position of wire rod 520 at the moment wire rod 520 transfers from the layer of advancing-side wire rod 520*a* to the layer of reversing-side wire rod 520*b*. According to the reciprocative movement of winding nozzle section 610 parallel to slant surface 530, it becomes possible to equalize the distance L1 to L2 and maintain them at the minimum value when wire rod 520 is wound around secondary spool 510. (Hereinafter, this winding method is referred to as "oblique traverse method")

Accordingly, a swingable width "W1" of wire rod 520 can be suppressed to a minimum value even at the position where wire rod 520 turns from advancing-side wire rod 520*a* to reversing-side wire rod 520*b*, i.e. at the winding position where wire rod 520 is wound directly on the outer cylindrical wall of secondary spool 510. Thus, the alignment of wire rod 520 wound around secondary spool 510 can be maintained adequately without being deteriorated. In this respect, the conventional winding apparatus has a tendency, such that the alignment of wire rod is deteriorated as wire rod 520 approaches the outer cylindrical wall of secondary spool 510. Compared with such a conventional winding apparatus, the winding apparatus of the present invention can improve the alignment of wire rod 520 and therefore prevent the winding collapse due to deterioration of alignment of wire rod 520, thereby improving the insulation quality.

In the third winding section 543, wire rod 520 is wound along slat surface 531 formed by the second winding section 542 so as to form advancing-side wire rod 520*a* and reversing-side wire rod 520*b* alternatively by the cross winding method. In this third winding section 543, the winding width for wire rod 520 is gradually narrowed as it approaches the winding end. Hence, the shift amount of traverse shaft section 609 is gradually reduced correspondingly. The alignment of wire rod 520 can be improved in the third winding section 543 as well as in the second winding section 542, because wire rod 520 is wound by the oblique traverse method previously described. Thus, it becomes possible to prevent the winding collapse from occurring due to deterioration of alignment of wire rod 520, thereby improving the insulation quality.

Second Embodiment

A second embodiment of the present invention will be explained hereinafter with reference to FIGS. 7 and 8. Examples of the second embodiment shown in FIGS. 7A, 7B and 8A have at least one flat surface formed on the outer cylindrical body of the secondary spool. The flat surface is formed by partly cutting or removing the cylindrical body of the secondary spool along a chord of a circular cross section of the cylindrical body. The flat surface extends in the axial direction of the cylindrical secondary spool. Another example of the second embodiment shown in FIG. 8B has at least one protrusion formed on the outer cylindrical wall of the secondary spool. This protrusion is formed as an edge portion having a triangular cross section and extends in the axial direction of the cylindrical second spool.

Figure 7A:
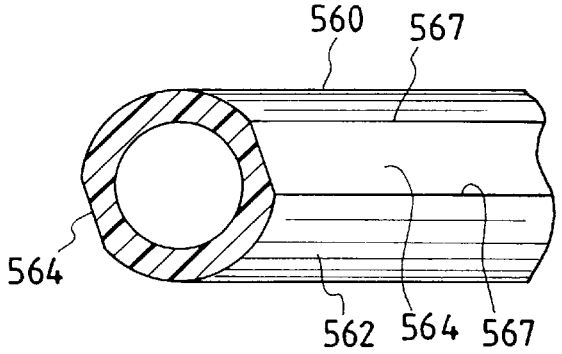
FIG. 7A is a perspective view partly showing a secondary spool in accordance with a second embodiment of the present invention.

As shown in FIG. 7A, a secondary spool 560 has a cylindrical body. Two flat surfaces 564 are formed on the outer cylindrical wall of secondary spool 560. These two flat surfaces 564 are spaced in the circumferential direction at intervals of 180° and respectively extend continuously in the axial direction of secondary spool 560. With provision of these flat surfaces 564 on the outer cylindrical wall of secondary spool 560, there is formed an edge portion 567 along the boundary between each flat surface 564 and each curve surface 562 where no flat surface 564 is formed. Provision of these continual flat surfaces 564 is effective to prevent the wire rod from sliding and causing undesirable dislocation in the axial direction of secondary spool 560 when wound around the outer cylindrical wall of secondary spool 560, because the wire rod is strongly engaged with the edge portions 567 by a pressing force acting in the radially inward direction of secondary spool 560 when the wire rod is wound.

Figure 7B:
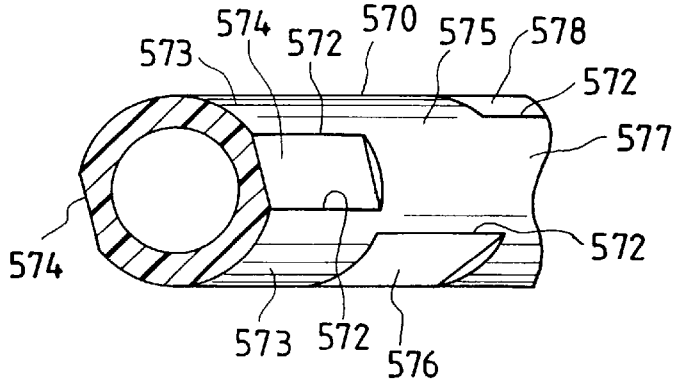
FIG. 7B is a perspective view partly showing another example of the secondary spool in accordance with the second embodiment of the present invention.

A modification of the secondary spool of the second embodiment shown in FIG. 7B is similar to the secondary spool 560 described above, but is different in that flat surfaces are partly formed in the axial direction and offset in the circumferential direction. More specifically, a secondary spool 570 has a cylindrical body. Two flat surfaces 574 are formed on the outer cylindrical wall of secondary spool 570. These two flat surfaces 574 are spaced in the circumferential direction at intervals of 180° and respectively extend partly in the axial direction of secondary spool 570. With provision of these flat surfaces 574 on the outer cylindrical wall of secondary spool 570, there is formed an edge portion 572 along the boundary between each flat surface 574 and a curve surface 573 where no flat surface 574 is formed. The axial width of each flat surface 574 is identical with the width of one layer of winding. Namely, flat surfaces 574 and their associated curve surfaces 573 are wound by the one winding layer. Another flat surfaces 576 are formed axially next to flat surfaces 574 and are offset from these flat surfaces 574 in the circumferential direction so as not to overlap each other. Flat surfaces 576 and their associated curve surfaces 575 are wound by the next winding layer. Similarly, still other flat surfaces 578 are formed axially next to flat surfaces 576 and are offset from these flat surfaces 576 in the circumferential direction so as not to overlap each other. Flat surfaces 578 and their associated curve surfaces 577 are wound by the next winding layer.

In this manner, a plurality of edge portions 572 are formed along the boundaries between curve surfaces 573 and flat surfaces 574, and between curve surfaces 575 and flat surfaces 576, and further between curve surfaces 577 and flat surfaces 578. Provision of these partial flat surfaces 574, 576 and 578 is effective to prevent the wire rod from sliding and causing undesirable dislocation in the axial direction of secondary spool 570 when wound around the outer cylindrical wall of secondary spool 570, because the wire rod is strongly engaged with the edge portions 572 by a pressing force acting in the radially inward direction of secondary spool 570 when the wire rod is wound as well as the secondary spool 560 above described.

Figure 8A:
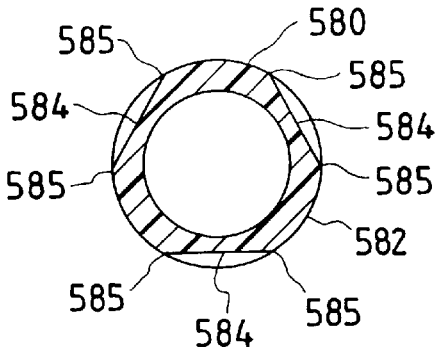
FIG. 8A is a radial cross-sectional view showing still another example of the secondary spool in accordance with the second embodiment of the present invention.

A modification of the secondary spool of the second embodiment shown in FIG. 8A is characterized in that a total of three flat surfaces 584 are formed on the outer cylindrical wall of a secondary spool 580 so as to be equally spaced at intervals of 120° in the circumferential direction. By providing three flat surfaces 584 in the circumferential direction, it becomes possible to increase the number of edge portions 585 formed along boundaries between curve surfaces 582 and flat surfaces 584. The engagement between the wire rod and edge portions, hence, can be enhanced as a whole in this secondary spool 580, when compared with the previously-described secondary spools 560 and 570. Thus, it becomes possible to surely prevent the wire rod from causing undesirable axial dislocation along the outer cylindrical wall of the secondary spool.

Figure 8B:
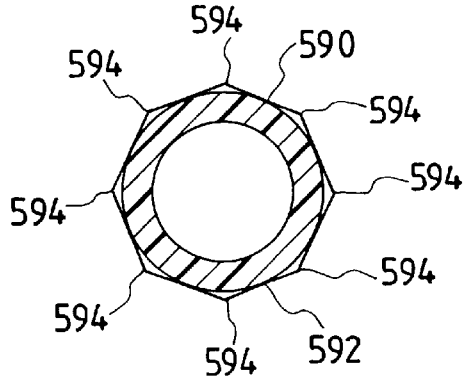
FIG. 8B is a radial cross-sectional view showing yet another example of the secondary spool in accordance with the second embodiment of the present invention.

A modification of the secondary spool of the second embodiment shown in FIG. 8B is characterized in that protrusions 594, each serving as an edge portion having a triangular cross section and extending in the axial direction, are formed on the outer cylindrical wall of a secondary spool 590 at intervals of 45° in the circumferential direction. Formation of these protrusions 594 on the outer wall of secondary spool 590 is effective to prevent the wire rod from sliding and causing undesirable dislocation in the axial direction of secondary spool 590 when wound around the outer cylindrical wall of secondary spool 590, because the wire rod is strongly engaged with the apexes of protrusions 594 by a pressing force acting in the radially inward direction of secondary spool 590 when the wire rod is wound. Hence, the effect of preventing the wire rod from dislocating in the axial direction of the secondary spool can be surely obtained in the same manner as the previously-described secondary spools 560, 570 and 580.

As described above, the secondary spools 560, 570, 580 and 590 of the second embodiment are different from, for example, a conventionally-known polygonal bobbin, and bring the following advantages. The configuration of secondary spools 560, 570, 580 and 590 is basically a cylinder having a circular cross section; hence, the force acting in the radially inward direction of the secondary spool when the wire rod is wound can be maintained at a uniform value, preventing the wire rod from being cut unexpectedly. Furthermore, it becomes possible to reduce the thickness of the cylindrical secondary spool, compared with the case where a polygonal bobbin is substituted for cylindrical ignition coil 2 of the first embodiment. Hence, ignition coil 2 can be manufactured compactly. In other words, the insulation quality can be adequately maintained without losing the merits of the cylindrical spool.

Third Embodiment

The winding method of an oblique lap winding coil in accordance with a third embodiment of the present invention will be explained with reference to FIG. 9.

Figure 9:
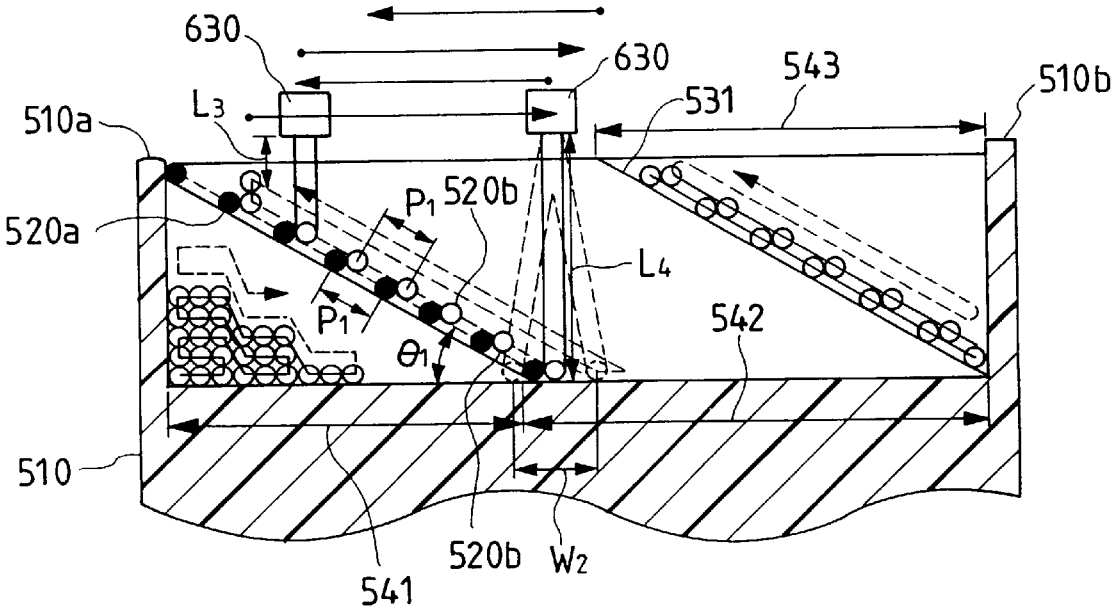
FIG. 9 is a cross-sectional view schematically showing a winding method of the oblique lap winding coil in accordance with a third embodiment of the present invention.

The third embodiment shown in FIG. 9 comprises a winding nozzle section 630 shifting along a rotational shaft (not shown) disposed in a spaced relation in parallel with the axis of secondary spool 510. In other words, the third embodiment is different from the first embodiment in that the oblique traverse method is not adopted.

As shown in FIG. 9, winding nozzle section 630 feeding out wire rod 520 causes a shift movement in parallel with the axis of secondary spool 510. In the second winding section 542 shown in FIG. 9, this winding nozzle section 630 is controlled by a control apparatus (not shown) in the following manner.

Like FIG. 1, FIG. 9 shows a condition where wire rod 520 is being wound in the second winding section 542, for schematically illustrating the movement of winding nozzle section 630. As well as the first embodiment, each black circle represents advancing-side wire rod 520*a* while each white circle represents reversing-side wire rod 520*b*.

Winding nozzle section 630 shifts at a predetermined winding pitch P1, which is two to 10 times as large as the diameter of wire rod 520, in accordance with rotation of bobbin rotating section (not shown). Hence, wire rod 520 extracted from winding nozzle section 630 is wound by this winding pitch P1 on the slant surface 530 formed by first winding section 541. In other words, wire rod 520 is wound spirally along the slant surface 530 at intervals of winding pitch P1. Therefore, in the same manner as in the first embodiment, wire rod 520 is wound by the cross winding method. This is advantageous to prevent reversing-side wire rod 520*b*, when wound on advancing-side wire rod 520*a*, from accidentally pulling away this advancing-side wire rod 520*a* from the predetermined winding position. Thus, undesirable excursion of wire rod 520 is surely eliminated. Hence, it becomes possible to prevent deterioration of insulation quality due to winding collapse.

Furthermore, winding nozzle section 630 is not the same as the winding nozzle section 610 of the first embodiment in that winding nozzle section 630 does not adopt the previously-described traverse method. Hence, a distance "L3" is not equal to a distance "L4", where "L3" represents a distance between winding nozzle section 630 and the winding position of wire rod 520 at the moment wire rod 520 wound around secondary spool 510 transfers from the layer of reversing-side wire rod 520*b* to the layer of advancing-side wire rod 520*a*. On the other hand, "L4" represents a distance between winding nozzle section 630 and the winding position of wire rod 520 at the moment wire rod 520 transfers from the layer of advancing-side wire rod 520*a* to the layer of reversing-side wire rod 520*b*. Hence, the swingable width "W2" of wire rod 520 at the winding position where wire rod 520 is wound directly on the outer cylindrical wall of secondary spool 510 is increased compared with the swingable width "W1" of wire rod 520 of the first embodiment. However, if increased swingable width "W2" is still satisfactory in view of adequately maintaining the alignment of wire rod 520 wound around secondary spool 510 without causing winding collapse, it will not be necessary to specially provide a rotational shaft disposed in parallel with slant surface 530 formed by the first winding section 541. Thus, the arrangement of the winding apparatus can be simplified and the product cost of the winding apparatus can be reduced.

Fourth Embodiment

The winding method of an oblique lap winding coil in accordance with a fourth embodiment of the present invention will be explained with reference to FIG. 10.

Figure 10:
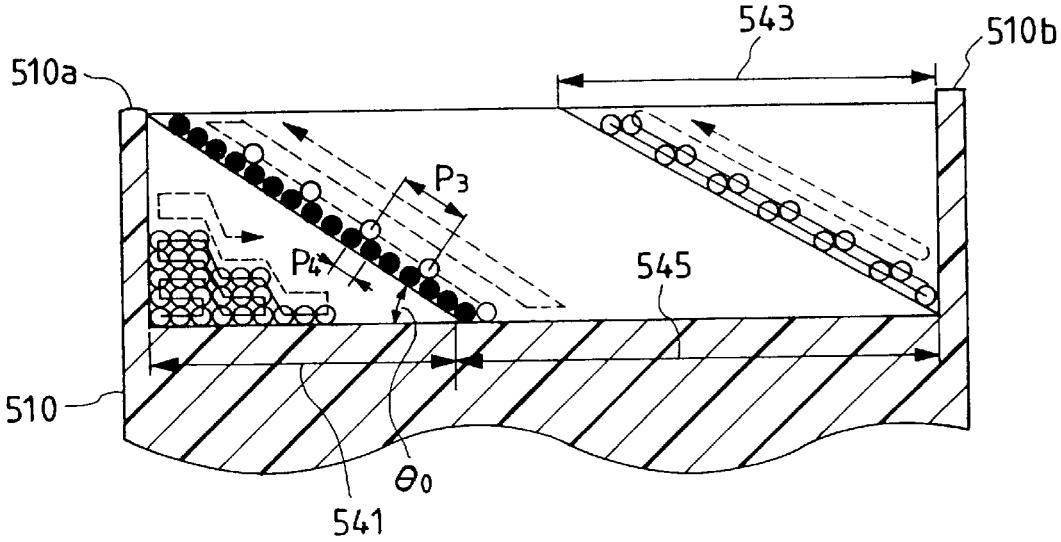
FIG. 10 is a cross-sectional view schematically showing a winding method of the oblique lap winding coil in accordance with a fourth embodiment of the present invention.
Figure 11:
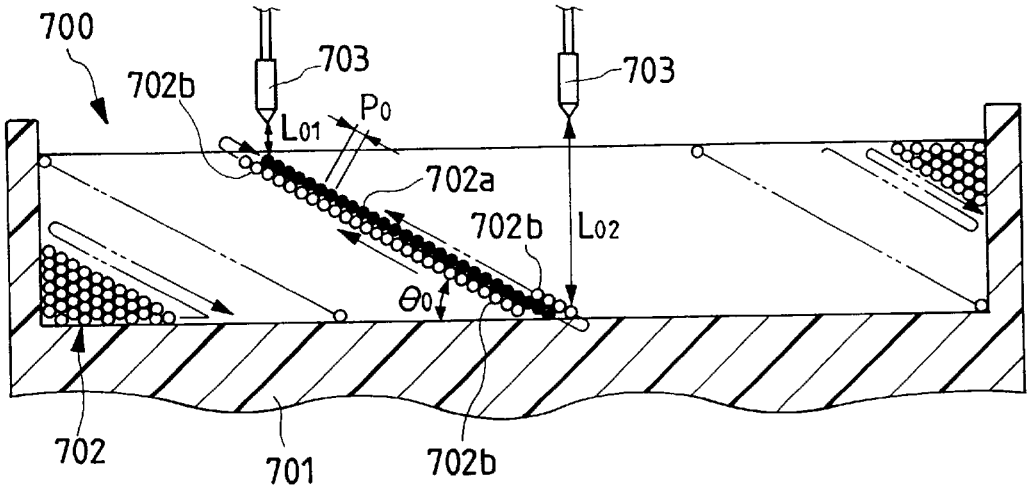
FIG. 11 PRIOR ART
FIG. 11 is a cross-sectional view schematically showing a conventional winding method of the oblique lap winding coil.

The fourth embodiment shown in FIG. 10 is characterized in that the winding pitch of the advancing-side wire rod 520*a* is differentiated from the winding pitch of the reversing-side wire rod 520*b*.

Like FIG. 1, FIG. 10 shows a condition where wire rod 520 is wound in the second winding section 545. As well as the first embodiment, each black circle of FIG. 10 represents advancing-side wire rod 520*a* while each white circle represents reversing-side wire rod 520*b*.

As shown in FIG. 10, the advancing-side wire rod 520*a*, wound by the cross winding method, is wound by a predetermined winding pitch P3 which is, for example, equivalent to two to 10 times the diameter of wire rod 520. Meanwhile, the reversing-side wire rod 520*b* is wound by a predetermined winding pitch P4 which is different from the winding pitch P3 and is, for example, less than two times the diameter of wire rod 520. With this winding ratio settings, the winding number of the reversing-side wire rod 520*b* is increased since its winding pitch P4 is narrow. In other words, it becomes possible to increase the winding number per single slant surface 530 formed by the first winding section 541. If it is assumed that the winding number of wire rod 520 in the second winding section 545 is identical with the winding number of wire rod 520 in the second winding section 542 of the first and third embodiments, increase of the winding number of wire rod 520 per single slant surface 530 makes it possible to reduce the number of reciprocative movements of the winding nozzle section for feeding out wire rod 520. Accordingly, the production efficiency can be improved in the step of winding the wire rod around secondary spool 510.

In short, the fourth embodiment of the present invention provides a plurality of winding layers comprising a wide-gap winding layer having a pitch of the wire rod equivalent to two to 10 times the diameter of the wire rod so as to have a gap. An upper winding layer is disposed on this wide-gap winding layer, while a lower winding layer is disposed below this wide-gap winding layer, in such a manner that the wire rod of the upper winding layer is brought into contact with the wire rod of the lower winding layer through the gap of the wide-gap winding layer.

Although the fourth embodiment sets the winding pitch P3 for the advancing-side wire rod 520*a* and sets the winding pitch P4 for the reversing-side wire rod 520*b*, the present invention is not limited to this winding pitch relationship only. For example, the winding pitch P4 can be applied to the advancing-side wire rod 520*a* while the reversing-side wire rod 520*b* has winding pitch P3.

As this invention may be embodied in several forms without departing from the spirit of essential characteristics thereof, the present embodiments as described are therefore intended to be only illustrative and not restrictive, since the scope of the invention is defined by the appended claims rather than by the description preceding them, and all changes that fall within metes and bounds of the claims, or equivalents of such metes and bounds, are therefore intended to be embraced by the claims.

What is claimed is:

1. An electromagnetic coil, comprising:

a cylindrical bobbin defining a winding section, said bobbin having a circular cross section;

an edge portion formed on an outer cylindrical wall of said winding section so as to extend in an axial direction thereof; and a wire rod wound on said winding section so as to form a plurality of slant layers sequentially extending from one end of said winding section toward another end of said winding section, wherein said outer cylindrical wall includes a plurality of auxiliary surfaces having a curvature different from that of a fundamental surface of said outer cylindrical wall, a corresponding edge portion extends along a boundary between a corresponding auxiliary surface and said fundamental surface, each of said auxiliary surfaces being a flat surface.

2. The electromagnetic coil according to claim 1, wherein said auxiliary surfaces comprise two flat surfaces spaced at intervals of 180° along a circumferential direction on said cylindrical bobbin.

3. The electromagnetic coil according to claim 1, wherein each of said flat surfaces extend in said axial direction only part of a way between said one end of said winding section to said another end of said winding section.

4. The electromagnetic coil according to claim 3, wherein each of said flat surfaces are offset in a circumferential direction along said cylindrical bobbin so as to not overlap.

5. The electromagnetic coil according to claim 1, wherein said auxiliary surfaces comprise three flat surfaces spaced at intervals of 120° along a circumferential direction on said cylindrical bobbin.

* * * * *